US006456259B1

(12) United States Patent
Krüger

(10) Patent No.: US 6,456,259 B1
(45) Date of Patent: Sep. 24, 2002

(54) RADIO EQUIPMENT

(75) Inventor: Werner Krüger, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/601,159

(22) PCT Filed: Jan. 29, 1998

(86) PCT No.: PCT/DE98/00261

§ 371 (c)(1),
(2), (4) Date: Sep. 20, 2000

(87) PCT Pub. No.: WO99/39402

PCT Pub. Date: Aug. 5, 1999

(51) Int. Cl.[7] ..... H01Q 1/24
(52) U.S. Cl. ..... 343/895; 343/702
(58) Field of Search ..... 343/702, 841, 343/851, 900, 901, 895; 455/90, 129, 127, 128, 575

(56) References Cited

U.S. PATENT DOCUMENTS

| | | | | |
|---|---|---|---|---|
| 4,163,981 A | 8/1979 | Wilson | ..... | 343/715 |
| 5,258,772 A | 11/1993 | Inanaga et al. | ..... | 343/895 |
| 5,329,287 A | 7/1994 | Strickland | ..... | 343/752 |
| 5,701,129 A | 12/1997 | Itou et al. | ..... | 343/873 |

FOREIGN PATENT DOCUMENTS

| | | |
|---|---|---|
| DE | 296 16 733 | 1/1997 |
| EP | 0 367 609 | 5/1990 |
| EP | 0 476 144 | 3/1992 |
| EP | 0 649 181 | 4/1995 |
| EP | 0 660 440 | 6/1995 |
| EP | 0 716 469 | 6/1996 |
| GB | 2 285 180 | 6/1995 |

OTHER PUBLICATIONS

IBM Technical Disclosure Bulletin, vol. 38, No. 5, May 1995, pp. 513–514.

*Primary Examiner*—Don Wong
*Assistant Examiner*—James Clinger
(74) *Attorney, Agent, or Firm*—Bell, Boyd & Lloyd LLC

(57) ABSTRACT

A radio device has an antenna, which can be retracted into a housing of the radio terminal device and can be withdrawn from the housing. The antenna includes a radiator in the form of helix.

11 Claims, 2 Drawing Sheets

RADIO EQUIPMENT

BACKGROUND OF THE INVENTION

1. Field of the Invention

The present invention is directed to a radio device of the type having an antenna which can be retracted into and withdrawn from a housing.

2. Description of the Prior Art

In given known radio devices or mobile telephone devices (for example, of the type GSM, PCN, PCS, etc.), a combination of an antenna part that is stationary relative to housing of the radio device and a telescoping antenna part is utilized as the antenna. For example, the stationary part is implemented in the form of a helix antenna, whereas the telescoping part is formed by a straight, elongated radiator.

The trend in mobile radiotelephone devices, particularly mobile telephone terminals, is toward smaller and smaller and more and more compact devices. Given extremely small devices, however, a retracted, straight, elongated radiator occupies a relatively large space within the device in relationship to the other components A further reduction in size of such mobile radio devices is precluded by the dimensions of the retractable antennas.

The mechanical length of a radiator given the aforementioned, combined antenna systems is dependent on the frequency to be employed and on the electrical wavelength derived therefrom. In order to achieve an optimal decoupling between the mobile radio device and the antenna in the radio range, the (telescoping) radiator is constructive with a specific length, for example half the electrical wavelength. A mechanically shorter embodiment of the radiator, for example at one-fourth of the electrical wavelength, would in fact be only half as long as the first-cited embodiment of the radiator. Given such a mechanically shortened radiator, however, the radiation behavior would be modified in an undesired way. First, the radiation behavior would be modified by parts of the radio device under the base of the antenna. Second, the radiation behavior also changes in a practically unpredictable way by grasping the device. Given these mechanically shortened radiators, moreover, radio frequency power given transmission events is also emitted beamed,into the body of the user to an extent that may lead to negative effects on health. For these reasons, such shortened radiators do not come into consideration for comprehensive practical use.

These influences can be minimized by a radiator having, for example, ½, ⅜ or ⅝ of the electrical wavelength. However, these advantages are at the expense of larger mechanical length.

It is also known to electrically lengthen mechanically shortened radiators with suitable components at the antenna base in order to obtain a resonant system. For example, an inductance is connected, for example, in series with the radiator. The efficiency of the antenna thereby changes inversely proportionally to the length of the radiator.

In addition to the disadvantage that an additional component is required, another disadvantage is comprised therein that only the shortened radiator contributes to the efficiency of the antenna in such an antenna system. Components at the base of the radiator do not participate in the efficiency and only serve to produce a system capable of resonance.

Given combined antennas that are composed, for example, of a stationary part and a telescoping part, it must also be taken into consideration that an adequate antenna gain must be produced, given an extended antenna compared to the retracted condition, but only the stationary part of the combined antenna is effective for this purpose.

SUMMARY OF THE INVENTION

It is an object of the present invention to provide a radio device with an antenna that can be manufactured with relatively small mechanical dimensions and which avoids or minimizes the aforementioned problems associated with known antennas for radio devices.

The above object is achieved in accordance with the principles of the present is invention in a radio device having an antenna which can be retracted into and withdrawn from a housing, and wherein the antenna has the structure of a radiator in the form of a helix.

The invention yields a number of advantages. The inventive radio device has a radiator that exhibits a smaller structural height compared to conventional radiators and that operates without employing an additional component or circuit part for electrical lengthening. The reception or transmission capability of the radiator of the inventive radio device corresponds to that of a conventional radiator.

The radiator of the inventive radio device exhibits the further advantage that the helix can be manufactured in a simple way, requires only relatively little material and thus contributes to a reduction of the weight of the radio device.

The inventive radio device further has the advantage that the emission behavior of the radiator can be adapted to the requirements of the application by forming different pitch angles of the helix. Given an application in the mobile radio field, thus, the RF-irradiation of the body of a user ("SAR", specific absorption rate) in transmission mode can be reduced, particularly in the head area.

DESCRIPTION OF THE PREFERRED EMBODIMENTS

The radiators schematically shown in FIGS. 1 through 5 are not shown to scale; the drawings only serve for illustrating the function principles.

Figure 1:
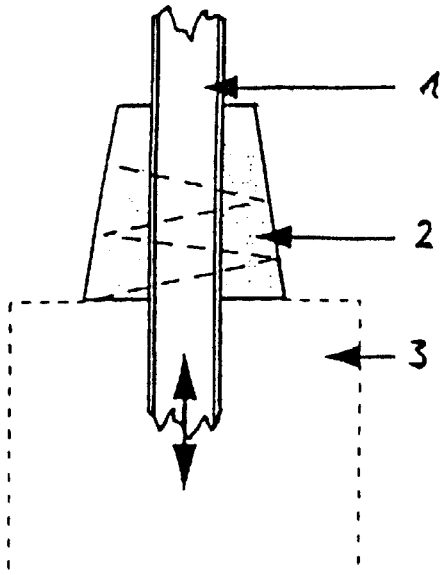
FIG. 1 is a schematic illustration of a telescoping antenna as is known from the prior art.

First, an antenna for mobile radio devices as employed in the prior art shall be explained on the basis of FIG. 1. An extensible, straight, elongated radiator 1 can be retracted into a housing 3 of the mobile radio device. This retractable extensible radiator 1 proceeds in the inside of a stationary helix antenna 2 that assures the reception in the retracted condition of the radiator. As mentioned in the earlier discussion herein of known antennas, the performance capability of such antennas is directly dependent on the mechanical length of the radiator. The longer the length of the retractable radiator, the more space is required to accommodate the retracted radiator inside of the mobile radio device.

The present invention shall now be explained with reference to a prefer exemplary embodiment on the basis of FIG. 2.

Figure 2:
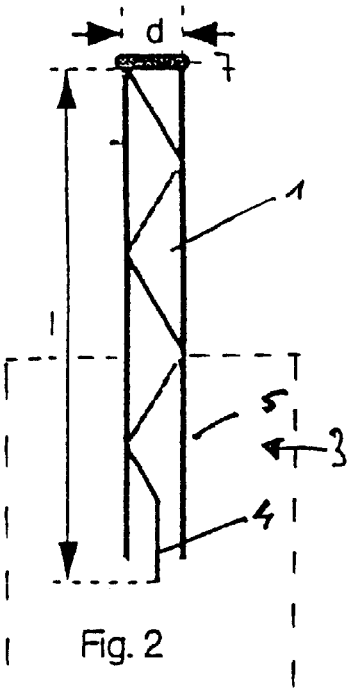
FIG. 2 is a schematic illustration of the basic structure of a radiator in a radio device according to the principles of the present invention.

FIG. 2 shows a coiled radiator 1 according to the present invention. In a known way, the radiator 1 can be introduced into housing 3 of a radio device and withdrawn therefrom. In particular, the radio device is a portable or mobile device, particularly a mobile telephone terminal.

The inventive radiator 1, which can be introduced into the housing 3 of the radio device and withdrawn from the housing, is fashioned in the form of a helix 4.

The material of the helix 4 preferably has high electrical conductivity for radio frequency radiation, for example silver-plated copper wire. The helix 4 can be wound on a cylindrical carrier ("inside carrier") 6 (FIG. 5) having a length l (mechanical length) and a diameter d and/or can lie internally against a cylindrical jacket-shaped cladding ("outside carrier") 5. The material of the inside carrier 6 and of the outside carrier 5 is electrically neutral; for example, Acrylin, Elastan or Delrin can be employed.

The radiator can comprise a cap 7 at its tip end termination, and this cap 7 can be mechanically connected to the outside carrier 5 and/or the inside carrier 6.

The diameter d of the helix 4 and the overall length l of the helix 4 are dependent on the frequencies employed.

Figure 3:
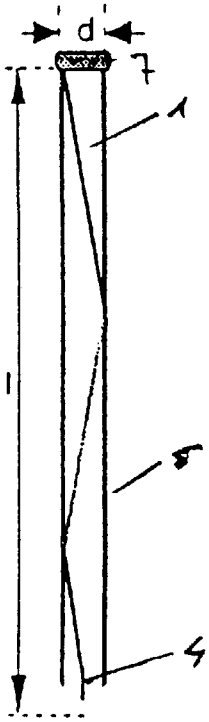
FIG. 3 is a schematic illustration of a radiator in a further embodiment of the invention with a relatively large pitch of the helix.
Figure 4:
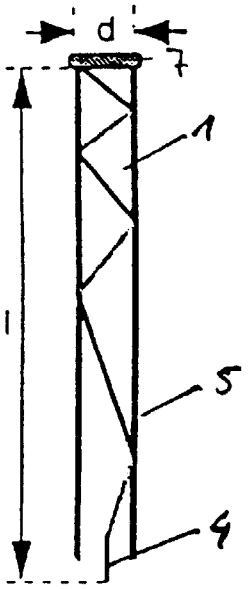
FIG. 4 shows a radiator according to an exemplary embodiment of the invention which has different pitch angles along the length of the radiator.

This helix 4 can, for example, be implemented as a thin wire whose length is greater than the length l of the helix 4 (FIGS. 2–4). As described, the helix can be wound on, for example, a cylindrical, straight carrier ("inside carrier") 6 and/or can lie internally against a cylindrical jacket-shaped cladding ("outside carrier") 5. Further, the helix 4 can be integrated in a body 8 of electrically neutral material. The body 8 has, in particular, the shape of a cylindrical jacket or of a cylinder. Different allocations of inside carrier 6, helix 4 and outside carrier 5 or body 8 that are yet to be described are shown in FIG. 5.

The helix 4 can have different pitch angles over the overall length l of the radiator, as shown in FIG. 4.

The different pitch angles of the helix 4 can be arranged along the overall length l of the radiator so that, resulting from the different energy distribution along the radiator, an intentional influencing of the radiation characteristic can be produced.

Given extremely small pitches of the helix 4 (see FIG. 2), a slight shortening of the radiator 1 that, however, is not practically relevant for numerous applications fundamentally arises at a given frequency due to parasitic effects that are of a mainly capacitative nature.

When the pitch of the helix 4 is fashioned extremely high, for example half a wavelength with approximately one turn, the mechanical length l of the radiator 1 approaches the length of a straight, elongated radiator, as shown in FIG. 3. The efficiency of the antenna is thereby greatest. In this case, the diameter d of the helix 4 can be small compared to the mechanical length l of the radiator 1. In general, the radiator can be implemented with a more smaller diameter as its mechanical length l increases.

When the pitch of the helix 4 is very small, the mechanical length l of the radiator 1 and its efficiency approach, for example, the length and the efficiency of a helix radiator 2 in combined antennas. Given extremely small pitches of the helix 4, the diameter d of the helix 4 must be large compared to the mechanical radiator length l in order to achieve an optimally high efficiency.

When, for example for design reasons, a specific mechanical length l is defined for the radiator 1, the pitch angle of the helix 4 derives from the given wavelength and the electrical length derived therefrom as well as from the prescription of the diameter d.

The pitch angle of the helix 4 can be and its diameter d small when a relatively slight mechanical shortening of the radiator 1 is selected.

In a preferred embodiment of the invention, the helix 4 has different pitch angles along the overall length l of the radiator 1. This is shown as an example in FIG. 4. As a result of these different pitch angles, the energy distribution along the radiator 1 can be intentionally influenced such that different radiation patterns can be formed. Given an application in the mobile radio field, thus, the RF-irradiation of the body of a user ("SAR", specific absorption rate) can be reduced in transmission mode, particularly in the head region.

Due to the fashioning of the different pitch angles, parasitic influences of the structure that is located under the antenna (for example, housing or metal parts of a mobile radio device) on the radiation pattern can be at least partly compensated or corrected.

Different allocations of inside carrier 6, coil 4 and outside carrier 5 or body 8 are shown in an enlarged scale in FIG. 5.

Figure 5A:
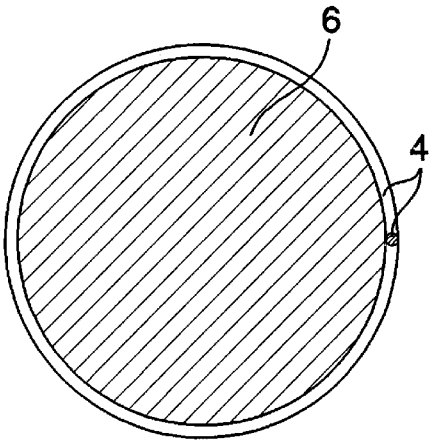
FIGS. 5*a*, 5*b*, 5*c* and 5*d* respectively show sections through the respective radiators in FIGS. 2 through 4.

FIG. 5*a* shows a section through the inside carrier 6 on which the helix 4 is wound.

Figure 5B:
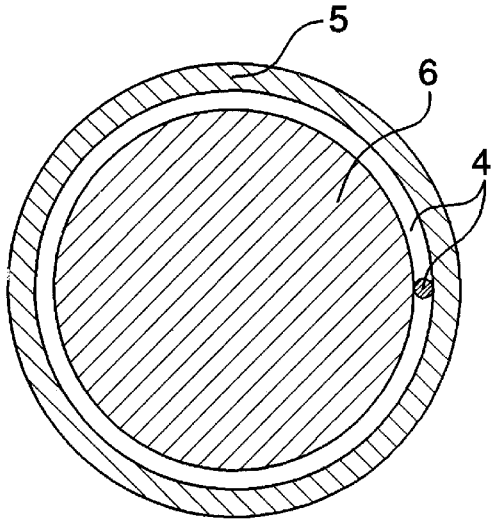

FIG. 5*b* shows a section through the inside carrier 6 on which the helix 4 is wound. The helix 4 is surrounded by an outside carrier 5 that is shown in section.

Figure 5C:
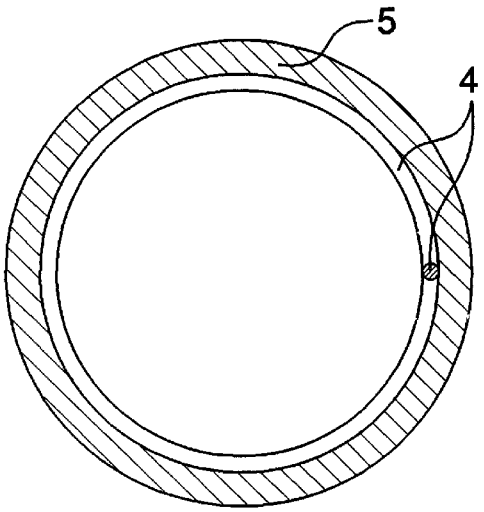

FIG. 5*c* shows an embodiment wherein no inside carrier is provided. In this embodiment, the helix 4 is surrounded by an outside carrier 5 that is shown in section. The helix 4 or the corresponding wire lies against the outside carrier 5 at the inside.

Figure 5D:
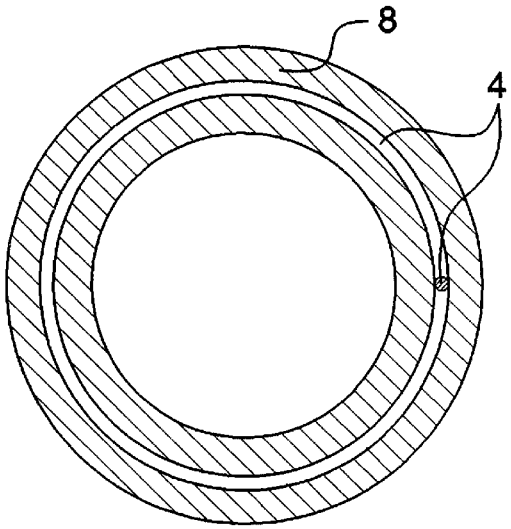

FIG. 5*d* shows a section through a body 8 in which the helix 4 is integrated.

In a further embodiment of the invention, the radiator 1 can be rigidly connected to the housing 3, i.e. cannot be retracted into the housing or, respectively, be withdrawn therefrom. The radiator 1 is then fashioned in the form of a helix 4, whereby the helix comprises different pitch angles over the overall length l of the radiator 1.

The different pitch angles of the helix 4 are arranged along the overall length l of the radiator 1 so that an intentional influencing of the radiation characteristic is possible.

The radiator 1 fixed to the housing 3 is composed of a wire that is coiled or wound around an electrically neutral, elongated carrier 5.

The coiled or wound wire can also lie against a cladding 6 of electrically neutral material (FIG. 5*b*). This cladding is preferably fashioned cylindrical jacket-shaped. The helix wire can likewise be integrated in a body 8.

The helix 4 of the stationary radiator can, moreover, have the same mechanical parameters (diameter; length, design of the pitch angle of the helix, material, etc.) and the same electrical parameters as the embodiment wherein the radiator can be retracted into the housing or withdrawn from the housing. The structure of the stationary radiator derives from FIG. 5.

The present invention is preferably employed in the mobile radio field and, particularly, in the mobile telecommunications or, respectively, mobile telephone field ("cell phone"). In addition, the invention can be utilized in systems wherein a short mechanical length of a radiator or a specific, definable radiation characteristic is required for an antenna.

Although modifications and changes may be suggested by those skilled in the art, it is the intention of the inventor to embody within the patent warranted hereon all changes and modifications as reasonably and properly come within the scope of his contribution to the art.

I claim as my invention:

1. A radio device comprising:

a housing;

an antenna which is retractable into and withdrawable from said housing; and said antenna comprising a radiator formed as a spread out coil of wire helix, and configured to direct radiation away from the head of a user.

2. A radio device as claimed in claim 1 wherein said helix of said radiator has a length and wherein said helix has a plurality of different pitch angles along said length.

3. A radio device as claimed in claim 1 wherein said antenna comprises an electnically neutral, elongated carrier, and a wire, forming said radiator, wound around said carrier.

4. A radio device as claimed in claim 1 wherein said antenna further comprises a cladding comprised of an electrically neutral material having an interior, said carrier and said wire being disposed in said interior of said cladding.

5. A radio device as claimed in claim 4 wherein said cladding comprises a cylindrical jacket.

6. A radio device as claimed in claim 1 wherein said antenna comprises an antenna body and a wire, forming said radiator, integrated in said antenna body.

7. A radio device comprising:

a housing;

an antenna rigidly connected to said housing; and said antenna comprising a radiator formed as a spread out coil of wire helix having a length, with a plurality of different pitch angles along said length, and configured to direct radiation away from the head of a user.

8. A radio device as claimed in claim 7 wherein said antenna comprises an electrically neutral, elongated carrier, and a wire, forming said radiator, wound around said carrier.

9. A radio device as claimed in claim 8 wherein said antenna further comprises a cladding comprised of an electrically neutral material having an interior, said carrier and said wire being disposed in said interior of said cladding.

10. A radio device as claimed in claim 9 wherein said cladding comprises a cylindrical jacket.

11. A radio device as claimed in claim 7 wherein said housing comprises a mobile radio terminal housing.

* * * * *